United States Patent [19]

Shindo et al.

[11] Patent Number: 4,996,022

[45] Date of Patent: Feb. 26, 1991

[54] PROCESS FOR PRODUCING A SINTERED BODY

[75] Inventors: Norikazu Shindo; Tomoyuki Sekine, both of Chofu; Yoshikatsu Nakamura, Omiya; Takashi Kawamoto, Urawa, all of Japan

[73] Assignees: Juki Corporation; Nippon Piston Ring Co., Ltd., both of Tokyo, Japan

[21] Appl. No.: 550,972

[22] Filed: Jul. 10, 1990

[30] Foreign Application Priority Data

Jul. 14, 1989 [JP] Japan ..... 1-181748
Jul. 14, 1989 [JP] Japan ..... 1-181749

[51] Int. Cl.[5] ..... B22F 1/00

[52] U.S. Cl. ..... 419/2; 419/36; 419/37; 419/38; 419/53; 419/54; 419/56; 419/57; 419/58

[58] Field of Search ..... 419/36, 37, 38, 53, 419/54, 56, 57, 58, 2

[56] References Cited

U.S. PATENT DOCUMENTS

| | | | |
|---|---|---|---|
| 4,113,480 | 9/1978 | Rivers | 419/36 |
| 4,305,756 | 12/1981 | Wiech, Jr. | 419/36 |
| 4,404,166 | 9/1983 | Wiech, Jr. | 419/36 |
| 4,534,936 | 8/1985 | Carlström et al. | 419/36 |
| 4,569,821 | 2/1986 | Duperray et al. | 419/36 |
| 4,661,315 | 4/1987 | Wiech, Jr. | 419/36 |
| 4,758,272 | 7/1988 | Pierotti et al. | 419/36 |
| 4,836,980 | 6/1989 | Kashiwadari et al. | 419/36 |
| 4,917,859 | 4/1990 | Hamo | 419/36 |
| 4,921,665 | 5/1990 | Klar et al. | 419/36 |

*Primary Examiner*—Stephen J. Lechert, Jr.
*Assistant Examiner*—Leon Nigohosian, Jr.
*Attorney, Agent, or Firm*—Frishauf, Holtz, Goodman & Woodward

[57] ABSTRACT

A sintered body is produced by a process comprising the steps of mixing one or more metal powder particles with an organic binder, injection-molding the mixture to form a green body of a predetermined shape, removing the binder from the green body to form a porous body substantially made of the metal powder, and heating the porous body to a sintering temperature and holding it at that temperature to produce a sintered body, in which process the binder is removed through the sequence of the following steps: preheating the green body in an inert gas atmosphere in a temperature range that creates open pores in it; placing the green body, in which open pores have started to form, in a hydrogen gas atmosphere optionally mixed with an inert gas; holding the green body in a temperature range where the metal powder is not carburized and where the open pores will be maintained, so that the greater part of the binder is removed to form a porous body that is substantially made of the metal powder alone; and further holding said porous body at said heating temperature for a sufficient period of time to vaporize the carbon in the small amount of residual binder in the porous body through reaction with hydrogen.

13 Claims, 4 Drawing Sheets

PROCESS FOR PRODUCING A SINTERED BODY

BACKGROUND OF THE INVENTION

1. Field of the Invention

This invention relates to a process for producing a sintered body from the particles of a sinterable metal. More particularly, this invention relates to a method of removing a binder from a "green body", as well as to a method of presintering a binder-removed porous body of metal powder particles prior to sintering.

2. Prior Art

A known conventional process for producing sintered bodies comprises the steps of: mixing metal powder particles with a binder composed of a thermoplastic resin, wax, etc.; forming pellets of the mixture; injection-molding the pellets to form a "green body" of a predetermined shape; heating the green body to remove the binder; and sintering the green body in vacuo at elevated temperatures to make an article of a desired shape.

In the step of removing the binder, the green body which has a three-dimensional shape is embedded in an alumina powder or the like in a binder removing furnace and, after the binder is removed, the resulting porous body is taken out of the alumina powder and fed into a separate sintering furnace where it is sintered.

Further, in order to ensure that the alumina powder and jigs that have been fouled during the step of binder removal do not enter the sintering furnace, the porous body must be transferred into a separate vessel before it is charged into the sintering furnace. Holding the porous body, alumina powder and jigs, transferring them, and other associated procedures are hereinafter collectively referred to as "handling".

The binder must be completely removed in the step of binder removal. However, the binder is an organic matter and when the porous body made of metal powder particles from which the greater part of the binder has been removed is heated at elevated temperatures, it is precipitated as carbon which deposits on both the inside and outside surfaces of the porous body and is not removed during the subsequent sintering step. To improve the corrosion resistance, magnetic properties and other characteristics of the sintered body, its carbon content must be reduced to adequately low levels. To meet this need, Japanese Patent Public Disclosure No. 283875/1987 proposed that the atmosphere in the binder removing furnace be saturated with water vapor and the precipitating free carbon be reacted with water vapor to prevent the deposition of carbon on the inside and outside surfaces of the porous body. However, the use of water vapor results in the formation of an oxide film on the surfaces of metal powder particles and an additional step must be provided for reducing this oxide film prior to the sintering step. Further, water vapor cannot be used in a case where the metal powder particles contain Cr and may form a film of chromium oxide and other materials that are very difficult to reduce.

SUMMARY OF THE INVENTION

Under these circumstances, it is an object of the present invention to provide a process for producing a low-carbon sintered body made of a particulate material that will cause neither precipitation nor deposition of carbon in the binder-removed porous body.

An injection-molded part of metal powder is supplied to the sintering step after it has been completely freed of the binder in the binder removal step. However, if the binder is completely removed, the resulting porous body has such a low level of strength that it is difficult to handle it without causing problems such as nicking.

Under these circumstances, it is another object of the present invention to provide a process for producing a sintered body of particulate material in which the porous body that has been completely freed of a binder in a binder removing step is rendered so as to have a desired strength to permit subsequent handling without causing nicking or other defects in the porous body.

The process of the present invention comprises the following basic steps: mixing one or more metal powder particles with an organic binder; injection-molding the mixture to form a green body of a predetermined shape; removing the binder from the green body to form a porous body substantially composed of the metal powder; and heating the porous body to a sintering temperature and holding it at that temperature to produce a sintered body. This process is characterized by removing the binder through the sequence of the following steps: preheating the green body in an inert gas atmosphere in a temperature range that creates open pores in its; placing the green body, in which open pores have started to form, in a hydrogen gas atmosphere optionally mixed with an inert gas; holding the green body in a temperature range where the metal powder is not carburized and where the open pores will be maintained, so that the greater part of the binder is removed to form a porous body that is substantially made of the metal powder alone; and further holding said porous body at said heating temperature for a sufficient period of time to vaporize the carbon in the small amount of residual binder in the porous body through reaction with hydrogen.

According to the present invention, the porous body formed by removing the binder from the green body in the manner described above is presintered, subjected to the necessary handling procedures and sintered.

DETAILED DESCRIPTION OF THE INVENTION

In the process of the present invention, the binder in the green body is removed by the following steps: first, the binder which is typically made of a thermoplastic resin, wax, etc. is removed from the green body by heating it in a binder removing furnace up to a temperature of about 700° C. at a rate of about 20° C. per hour; then, the binder removing furnace is filled with a mixture of inert and hydrogen gases and the porous body during removal of the binder is held for a predetermined period of time at such a temperature that the residual binder will not cause a carburizing of the porous body, and such that the porous body will not be sintered to shrink but will instead maintain open pores, and that the carbon in the binder is removed as a hydrocarbon gas. As a result of these steps, the carbon is completely removed from the porous body, which contributes to the production of a sintered body having low levels of carbon.

Another advantage of the present invention is that presintering proceeds during the above-described procedure to impart sufficient strength to the porous body to permit it to be handled with great ease and to markedly improve the production rate by automation.

Embodiments of the present invention are described below with reference to the accompanying drawings.

Figure 1:
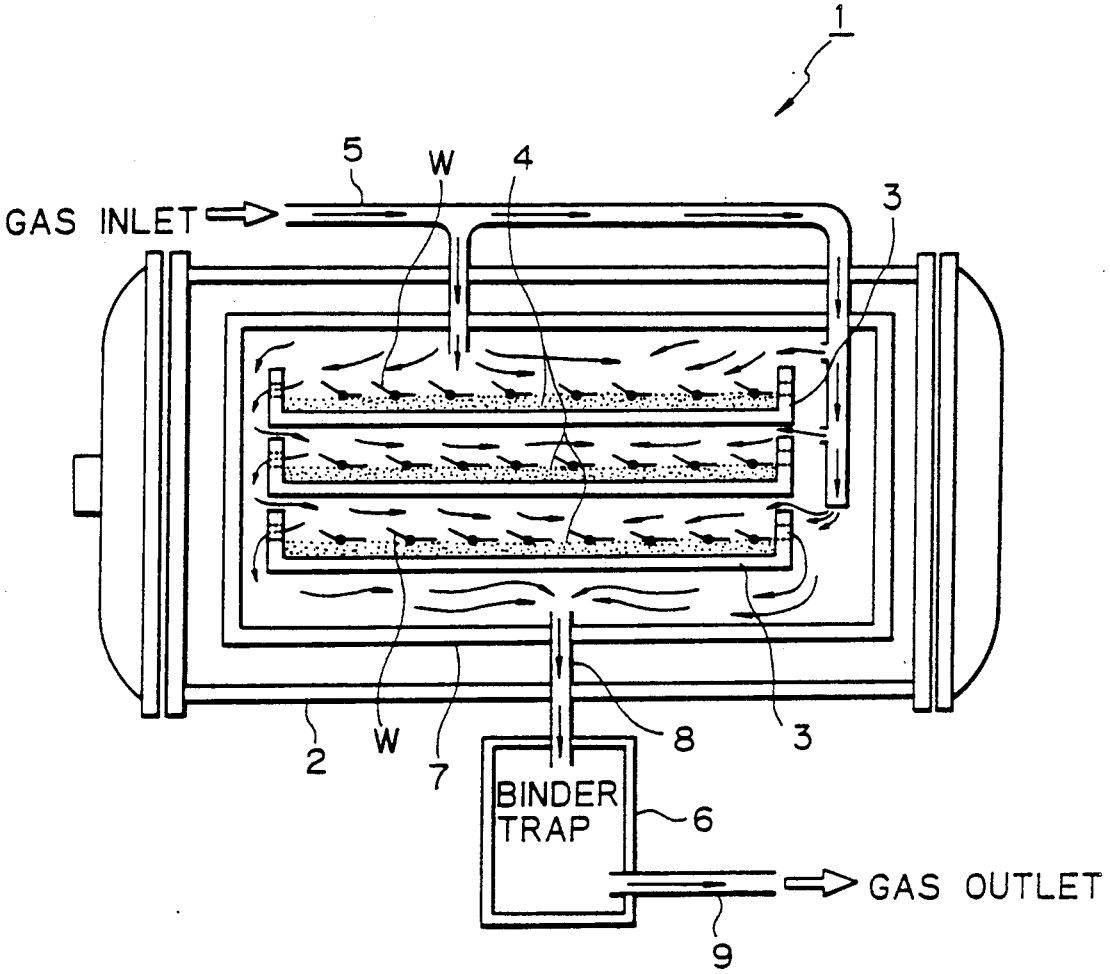
FIG. 1 shows schematically a furance for binder removal and presintering.

FIG. 1 shows a furnace for removing the binder and, optionally, performing calcination according to the present invention. The furnace generally indicated by 1 has an outer casing 2 which accommodates a stack of treating vessels 3, . . . 3. Each of the vessels contains an alumina powder 4 in which are placed green bodies W of a predetermined shape. The vessels 3 are surrounded by an inner casing 7 which is supplied via a pipe 5 with a gas or gases for creating an atmosphere for binder removal in the furnace 1. The gas containing the vaporized binder is discharged through a pipe 8 into a trap 6, where the vaporized binder is removed. The remaining gas is thereafter discharged from the system through a pipe 9.

The green bodies W can be prepared by a known method that comprises mixing one or more metal powder particles (e.g. Fe or Ni) having an average size of a few microns with a binder typically made of a thermoplastic resin, wax, etc., pelletizing the mixture, and molding the pellets into a desired form with a conventional injection-molding machine. The so prepared green bodies are either placed on or embedded in the alumina powder in each of the vessels 3 where the binder is removed from the green bodies. The green bodies W may be as-molded by injection-molding or they may be partly freed of the binder by preliminary treatment with a solvent that dissolves the binder.

Figure 2:
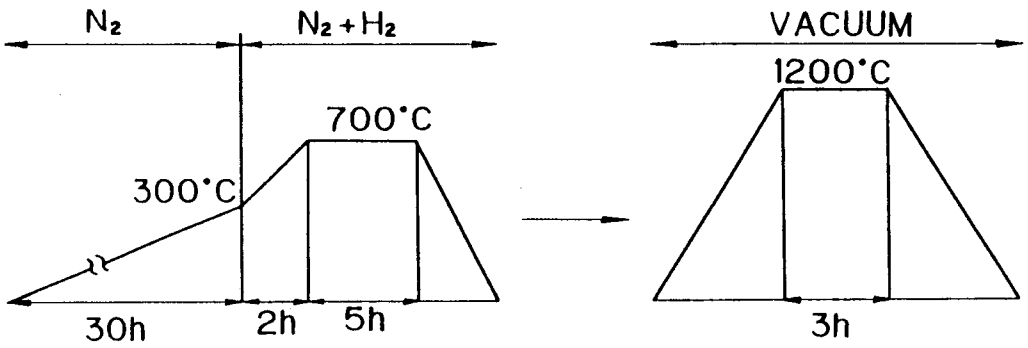
FIG. 2 is a diagram showing the heating pattern used in a first embodiment of the present invention.
Figure 3:
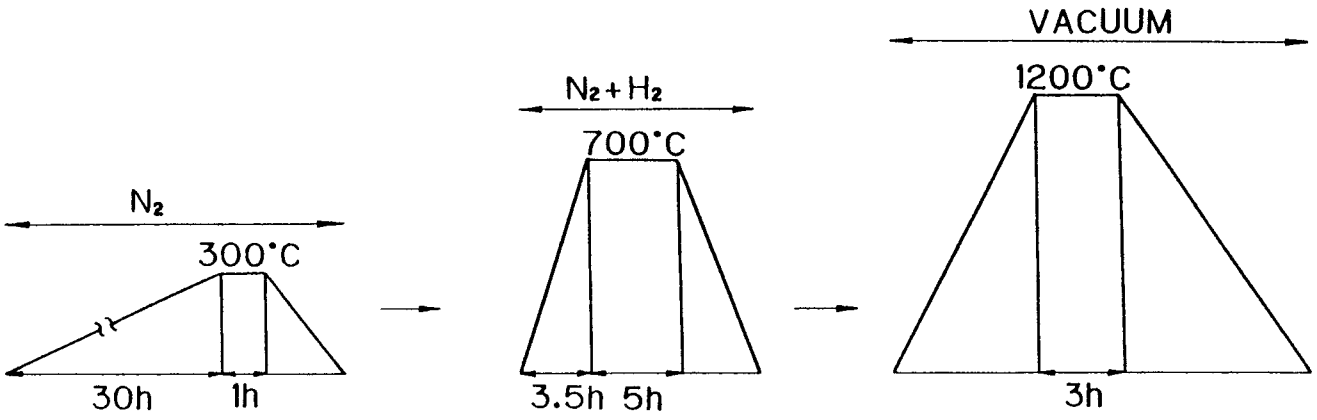
FIG. 3 is a diagram showing the heating pattern used in a second embodiment of the present invention.
Figure 4:
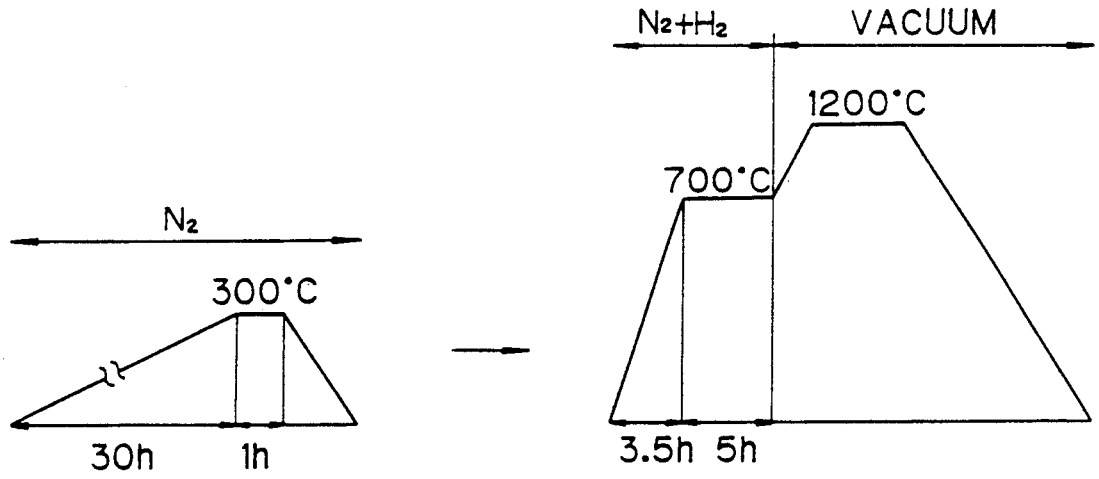
FIG. 4 is a diagram showing the heating pattern used in a third embodiment of the present invention.

The binder removal and calcination procedure described above may be performed according to the heating patterns shown in FIGS. 2–4.

In the first embodiment shown in FIG. 2, nitrogen gas ($N_2$) is supplied into the furnace through pipe 5 and the temperature in the furnace is first elevated up to 300° C. at a rate of about 10° C. per hour. When the atmosphere in the furnace is in the range of from room temperature to 300° C., the binder will vaporize rapidly so the temperature must be elevated at a comparatively slow rate. If the temperature elevation is rapid in this range, the green body will crack or form a blister. When the temperature in the furnace has been increased to 300° C., about 40% of the vaporized binder will be captured by the trap 6. In the step of binder removal described above, the temperature in the furnace is elevated up to 300° C. in a nitrogen atmosphere, so the metal powder is effectively protected against oxidation while it is freed of the binder.

Figure 5:
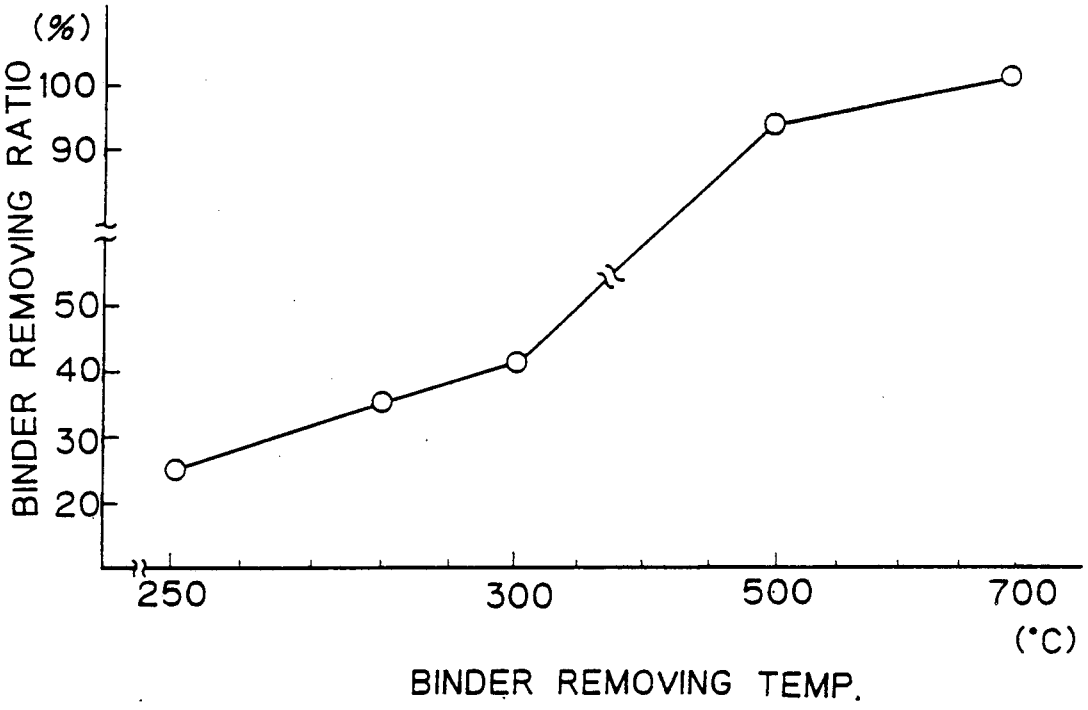
FIG. 5 is a graph showing the relationship between the temperature and the percent removal of the binder.

An empirical relationship between the temperature and the percent removal of binder is shown in FIG. 5; when the green body W was heated to 250° C., about 25% of the binder was vaporized from the green body; at 280° C., 34% of the binder was removed; at 300° C., 40% of the binder was removed; at 500° C., 95% of the binder was removed; and when the temperature was elevated to 700° C., substantially all of the binder was removed.

Following the removal of the binder, a mixture of an inert gas such as nitrogen is supplied with hydrogen into the furnace 1 via the pipe 5, and the porous body is presintered by heating the atmosphere in the furnace up to 600°–800° C., preferably 650°–750° C., at a preferably rate of 200° C. per hour. After holding the porous body at that temperature, most preferably at 700° C., for 2–5 hours, the porous body is cooled to room temperature. The temperature of 700° C. is in the range where the metal powder will be neither carburized nor sintered completely, and where the porous body will not shrink and will instead retain a sufficient number of open pores. By holding the porous body at 700° C. for about 5 hours, the residual carbon is sufficiently reacted with the hydrogen gas to be removed as a hydrocarbon gas. In the previous stage where the temperature in the furnace was raised to 300° C., about 40% of the binder was removed to make the green body porous, with a number of open pores created that establish communication between the interior and the exterior of the green body. Hence, the porous body can be subsequently heated at a rapid rate without producing any defects since the gases in the binder will smoothly flow out of the body via said open pores. The hydrogen content of the gaseous mixture is preferably at least 5% and it should be increased as the amount of residual binder in the porous body increases.

As already mentioned, about 40% of the binder is removed when the green body is heated up to 300° C. The binder that has charred and which remains unremoved in this stage is removed as a hydrocarbon gas that forms as a result of reaction with the hydrogen gas in the furnace which occurs when the temperature is elevated to 600°–800° C. and maintained at that level for a predetermined period of time. Hence, a very small amount of carbon will remain on the surface of the porous body and there will be no carbon left in the finally obtained sintered body.

When the porous body is held at 600°–800° C. for about 2 hours in the gaseous mixture of nitrogen and hydrogen, it will shrink by a very small amount which is no greater than 1%, and the porous body will be presintered in that shrinking state. Below 600° C., the porous body will not have a sufficient strength to protect against nicking during handling. Above 800° C., carburization will occur and the amount of carbon on the surface of the porous body starts to increase.

The porous body that has been subjected to the step of binder removal and presintering is then supplied to a separate vacuum furnace, where it is sintered by heating up to 1,200° C. and holding at that temperature for about 3 hours.

FIG. 3 shows the heating pattern employed in second embodiment of the present invention. First, as in the embodiment shown in FIG. 2, the temperature in the binder removing furnace filled with nitrogen gas is elevated to 300° C. at a rate of 10° C./h and the green body is held at 300° C. for about 1 hour. Thereafter, the green body is cooled to room temperature. The resulting porous green body is heated in a gaseous mixture of nitrogen and hydrogen up to 600°–800° C. at a rate of about 200° C./h, and the porous body thus obtained is held at that temperature, most preferably at 700° C., for about 5 hours to effect presintering. Subsequently, the presintered body is transferred to a vacuum furnace where it is sintered in accordance with the same heating pattern as shown in FIG. 2, in which it is heated to 1,200° C., held at that temperature for about 3 hours and thereafter cooled to room temperature.

According to the heating pattern shown in FIG. 2, the green body is heated to 300° C. in a nitrogen gas atmosphere, and the resulting porous green body is heated to 600°-800° C. to form a completely porous body, which is then sintered in a vacuum furnace. On the other hand, according to the heating pattern shown in FIG. 3, the green body is heated up to 300° C. in a nitrogen gas atmosphere and held at that temperature for about 1 hour before it is cooled to room temperature. Thereafter, the temperature of the resulting porous green body is elevated from room temperature to a higher level, most preferably to 700° C., and the porous body thus obtained is presintered by holding it at 700° C. for about 5 hours and subsequently sintered by elevating the temperature to 1,200° C., followed by cooling to room temperature. Another heating pattern that can be adopted in the practice of the present invention is depicted in FIG. 4. The numerals noted in FIGS. 2-4 are intended to indicate most preferred values and it should be understood that the scope of the present invention is in no way limited to the specific temperatures and rates of temperature elevation shown in these figures.

The present invention is described below in greater detail with reference to examples.

EXAMPLE 1

A powder of pure carbonyl iron (60 vol %) was mixed with 40 vol % of a binder composed of a thermoplastic resin, wax, etc. and the resulting mixture was kneaded and then pelletized. The pellets were injection-molded to form green bodies, which were processed in a furnace of the type shown in FIG. 1 according to the heating patterns shown in FIGS. 2-4 with the furnace being filled with the gases also shown in FIGS. 2-4.

EXAMPLE 2

Green bodies prepared as in Example 1 were processed in a furnace of the type shown in FIG. 1 according to the heating patterns shown in FIGS. 2-4 with the furnace being filled with nitrogen gas alone.

A comparison of the results of the two examples is shown in the following table.

Table of Comparison

| | Parameter | | | | | | | | | | |
|---|---|---|---|---|---|---|---|---|---|---|---|
| | C content | Relative density | Magnetic flux density | | | | | | Coercive force | Permeability | |
| Example | (wt %) | (%) | $B_2$ | $B_5$ | $B_{10}$ | $B_{25}$ | $B_{50}$ | Br | Hc | μo | μm |
| 1 | 0.008 | 94.7 | 8985 | 12300 | 13150 | 14040 | 14360 | 13040 | 2.094 | 1480 | 4497 |
| 2 | 0.15 | 96.8 | 1760 | 8120 | 10920 | 13040 | 14320 | 10440 | 2.7 | 435 | 1697 |

The parameters that were compared in the two examples were the carbon content of sintered body, its relative density, magnetic flux density, coercive force and permeability.

In Example 1, the residual carbon in the sintered body was negligible (0.008 wt %). In Example 2 which did not use hydrogen gas in the step of binder removal, the residual carbon content increased to 0.15%. Further, at points $B_2$ and $B_5$ where the strength of magnetic field in the magnetic hysteresis of the sintered body was small, the values in Example 1 were significantly higher than those in Example 2. The sintered body of Example 1 also had a higher value of residual flux density (Br) than that of Example 2. On the other hand, there was no substantial difference in coercive force between Examples 1 and 2, whereas the sintered body of Example 1 had far higher values of initial permeability (μo) and maximum permeability (μm) than the sintered body of Example 2.

In short, the sintered body fabricated by the process of the present invention had good magnetic characteristics in the range where the strength of magnetic field was small, and this is expected to substantially expand the scope of applications where the sintered body of the present invention can be used as a magnetic material. Further, the porous bodies that had been presintered subsequent to, the removal of binder had satisfactory strength and could be handled without causing damage such as nicking or distintegration.

Having the features described hereinabove, the present invention offers the advantage that a porous body having an extremely low level of residual carbon can be obtained by complete removal of the binder, which contributes to the production of a low-carbon sintered body. The added advantage of the invention is that the porous body which is presintered prior to sintering can be handled in a safe and easy manner for subsequent sintering.

What is claimed is:

1. In a process for producing a sintered body comprising the steps of mixing one or more metal powder particles with an organic binder, injection-molding the mixture to form a green body of a predetermined shape, removing the binder from the green body to form a porous body substantially composed of the metal powder, and heating the porous body to a sintering temperature and holding it at that temperature to produce a sintered body, the improvement wherein the binder is removed through the sequence of the following steps: preheating the green body in an inert gas atmosphere in a temperature range that creates open pores in it; placing the green body, in which open pores have started to form, in a hydrogen gas atmosphere optionally mixed with an inert gas; holding the green body in a temperature range where the metal powder is not carburized and where the open pores will be maintained, so that the greater part of the binder is removed to form a porous body that is substantially made of the metal powder alone; and further holding said porous body at said heating temperature for a sufficient period of time to vaporize the carbon in the small amount of residual binder in the porous body through reaction with hydrogen.

2. The process according to claim 1 wherein the hydrogen content of said gaseous mixture is at least 5%.

3. The process according to claim 1 or 2 wherein the binder is removed at a temperature in the range of 600°-800° C.

4. The process according to claim 1 or 2 wherein the porous body obtained by removing the binder from said green body is presintered by elevating its temperature, with the presintered body being subsequently sintered.

5. The process according to claim 4 wherein the temperature for presintering is at 600°-800° C.

6. The process according to claim 3 wherein the porous body obtained by removing the binder from said green body is presintered by elevating its temperature, with the presintered body being subsequently sintered.

7. The process according to claim 6 wherein the temperature for presintering is at 600°-800° C.

8. The process according to claim 4 wherein the temperature for presintering is about 700° C.

9. The process according to claim 7 wherein the temperature for presintering is about 700° C.

10. The process according to claim 1 wherein said metal is iron.

11. The process according to claim 7 wherein said metal is iron.

12. The process according to claim 1 wherein iron carbonyl powder is mixed with a thermoplastic binder.

13. The process according to claim 7 wherein 60 vol. % of iron carbonyl powder is mixed with 40 vol. % of a thermoplastic binder.

* * * * *